US005435295A

United States Patent [19]

Gerrard

[11] Patent Number: 5,435,295

[45] Date of Patent: Jul. 25, 1995

[54] FIREPLACE RACK

[76] Inventor: Paul H. Gerrard, 1276 Maple Crossing Blvd. Suite 1402, Burlington, Ontario L7S 2J9, Canada

[21] Appl. No.: 154,104

[22] Filed: Nov. 18, 1993

[51] Int. Cl.[6] ..... F24B 1/193

[52] U.S. Cl. ..... 126/541; 126/152 B; 211/60.1; 211/181

[58] Field of Search ..... 126/512, 92 R, 9 R, 126/540, 543, 152 B, 152 A, 555, 541; 248/153, 173; 211/181, 60.1, 195

[56] References Cited

U.S. PATENT DOCUMENTS

| | | | |
|---|---|---|---|
| 3,508,536 | 4/1970 | McEwan | 126/541 |
| 3,669,092 | 6/1972 | Bolster | 126/541 |
| 4,329,974 | 5/1982 | Reichert | 126/541 |
| 4,373,508 | 2/1983 | Northcraft | 126/541 |
| 4,637,372 | 1/1987 | Mogol et al. | 431/125 |
| 4,748,993 | 6/1988 | Llewellyn | 211/181 |
| 4,838,781 | 6/1989 | Fischer | 126/512 |
| 5,026,271 | 6/1991 | Orlov et al. | 126/512 |
| 5,067,476 | 11/1991 | Rhodes, Jr. | 431/125 |
| 5,118,539 | 6/1992 | Sebby et al. | 431/125 |

*Primary Examiner*—James C. Yeung

[57] ABSTRACT

The present invention provides a fireplace rack for use with paper wrapped compressed fire logs in wood burning masonry or steel fireplaces and a portable fireplace unit. The rack comprises a base for supporting one or more fire logs and an upper frame adapted to support a display of artificial logs so that when lit, the paper wrapped fire logs burn up through the artificial logs to give the ambience and appearance of a real pile of logs.

8 Claims, 3 Drawing Sheets

FIREPLACE RACK

BACKGROUND OF THE INVENTION

1. Field of the invention

This invention relates to fireplace grates and more particularly relates to a rack for holding paper wrapped compressed fire-logs.

2. Description of the Prior Art

The use of paper-wrapped compressed fire-logs in place of real firewood is growing. Firewood is relatively expensive, dirty, hard to handle and store. In addition, if it is wet or newly cut it can be difficult to light.

On the other hand paper wrapped compressed fire-logs are safer for the chimney and are environmentally friendly. The only problem with the paper wrapped fire-logs is that when burning they are not as aesthetically pleasing as firewood.

SUMMARY OF THE INVENTION

It is an object of the invention to provide an improved fireplace grate that can accommodate paper wrapped compressed fire-logs and provide an aesthetically pleasing fire.

Thus, in accordance with the present invention, there is provided a wire rack comprising a base for supporting one or more paper wrapped compressed fire-log(s) and an upper frame pivotally connected to the base. The base and upper frame are preferably formed of 5/16 inch low-carbon steel. The upper frame is designed to support a display of vacuum formed ceramic fibre artificial logs. The upper frame pivots to permit the wire rack to be opened so that a paper-wrapped compressed fire-log(s) can be placed on the base. In use the upper frame is closed so that when lit, the paper-wrapped compressed fire-log(s) burns up through the ceramic fibre artificial logs to give the ambience and appearance of a real pile of logs burning.

Further features of the invention will be described or will become apparent in the course of the following detailed description.

BRIEF DESCRIPTION OF THE DRAWINGS

In order that the invention may be more clearly understood, the preferred embodiment thereof will now be described in detail by way of example, with reference to the accompanying drawings, in which.

DETAILED DESCRIPTION OF THE PREFERRED EMBODIMENT

Figure 3:
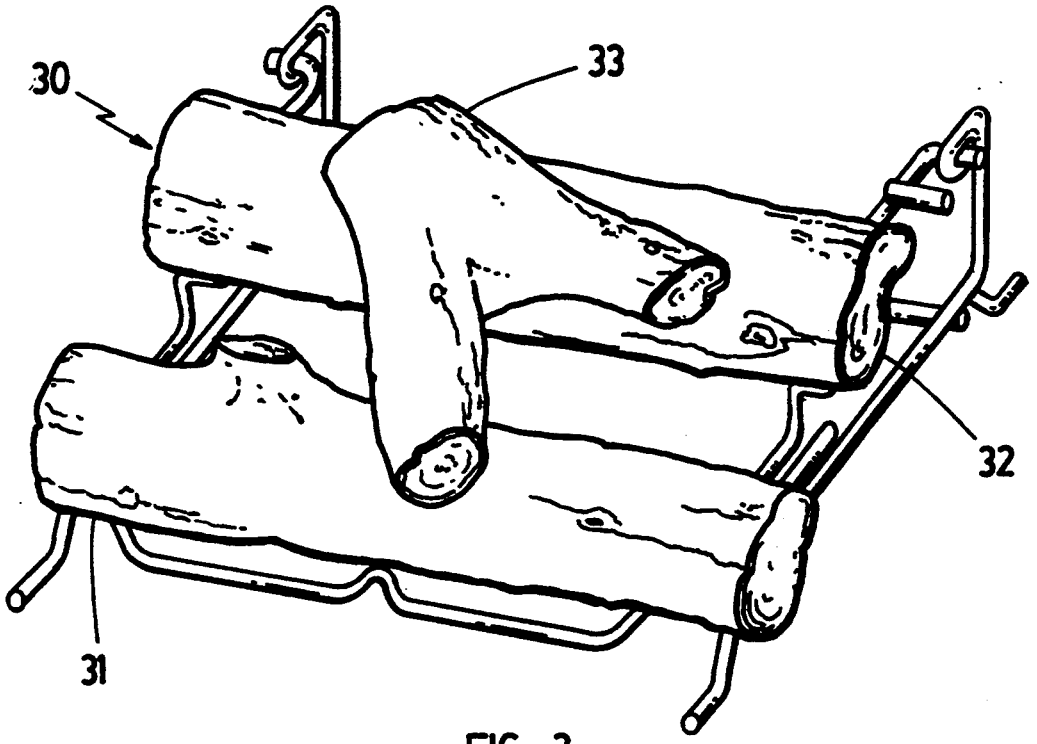
FIG. 3 is a perspective view of the combination rack and ceramic fibre artificial logs of the present invention
Figure 4:
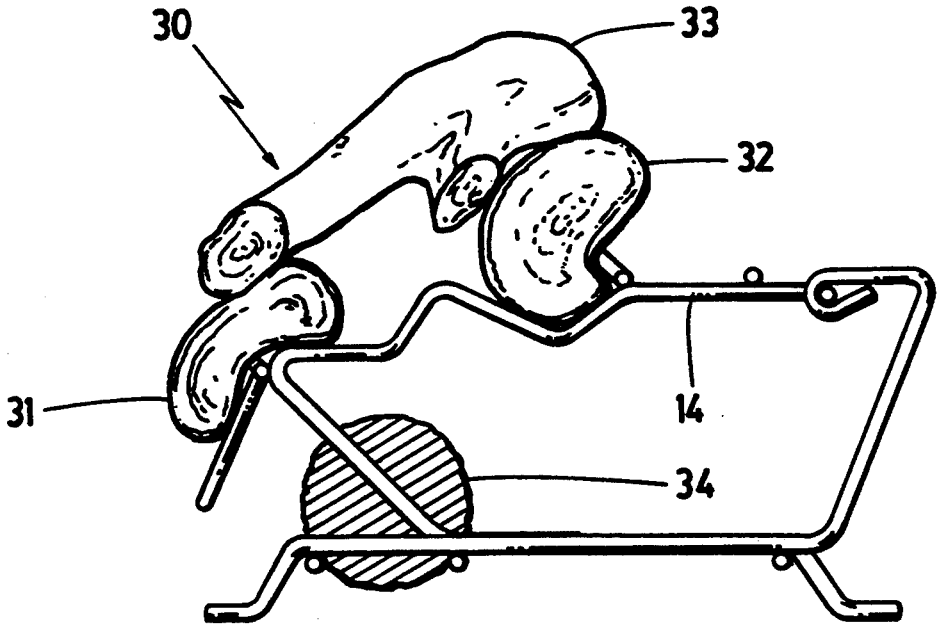
FIG. 4 is a side view of the combination of FIG. 3.

Referring to the drawings, the wire rack 1 of the present invention consists of a base 2 for supporting one or more paper wrapped compressed fire-log(s) and an upper frame 3 pivotally connected to the base 2. The base and upper frame are preferably formed of 5/16 inch low-carbon steel. The upper frame 3 is designed to support a display 30 of vacuum formed ceramic fibre artificial logs as shown in FIGS. 3 and 4. The upper frame pivots to permit the wire rack to be opened so that a paper-wrapped compressed fire-log can be placed on the base. In use the upper frame is closed so that when lit, the paper-wrapped compressed fire-log burns up through the ceramic fibre artificial logs to give the ambience and appearance of a real pile of logs burning.

Figure 1:
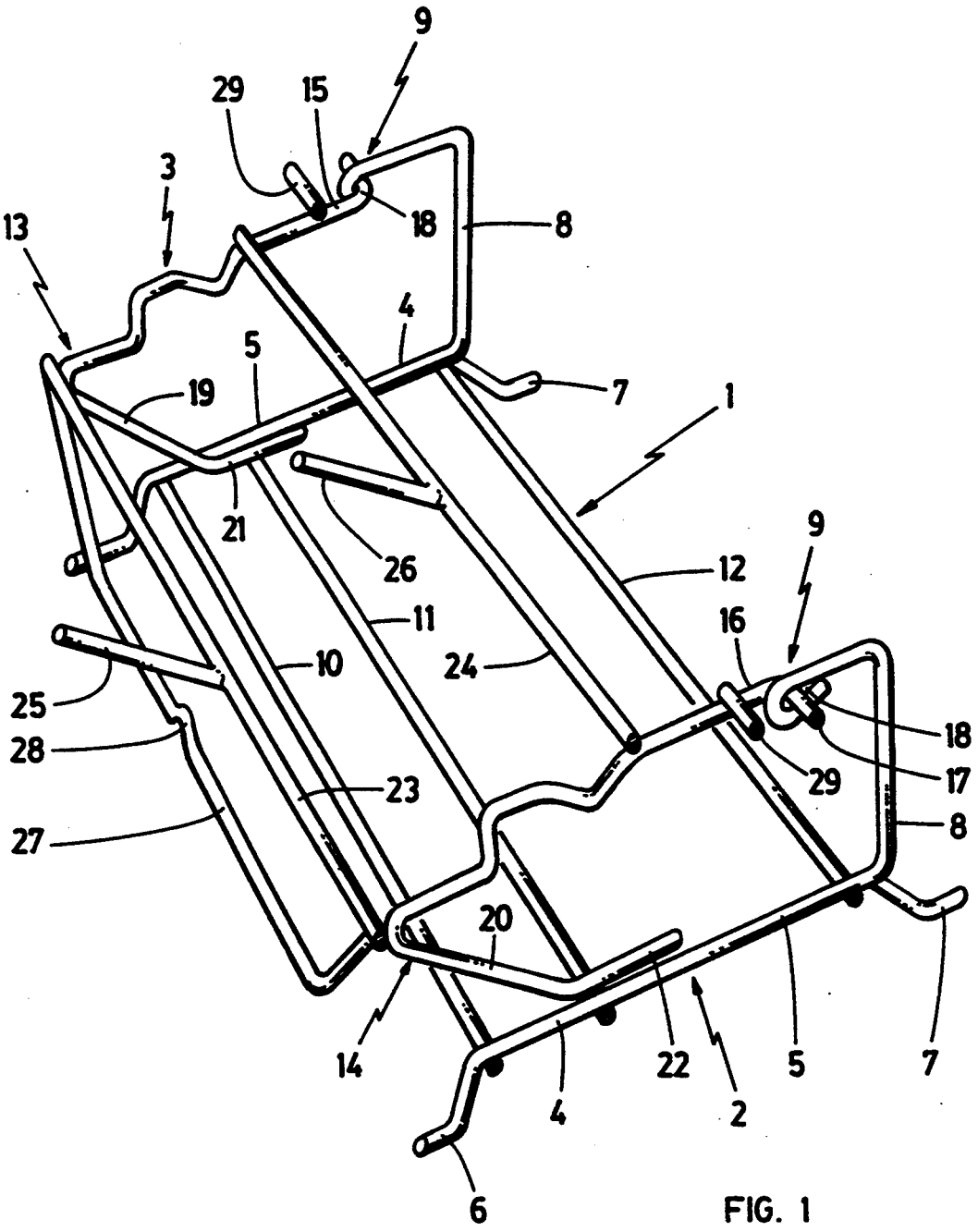
FIG. 1 is a perspective view of the rack of the present invention in the closed position.
Figure 2:
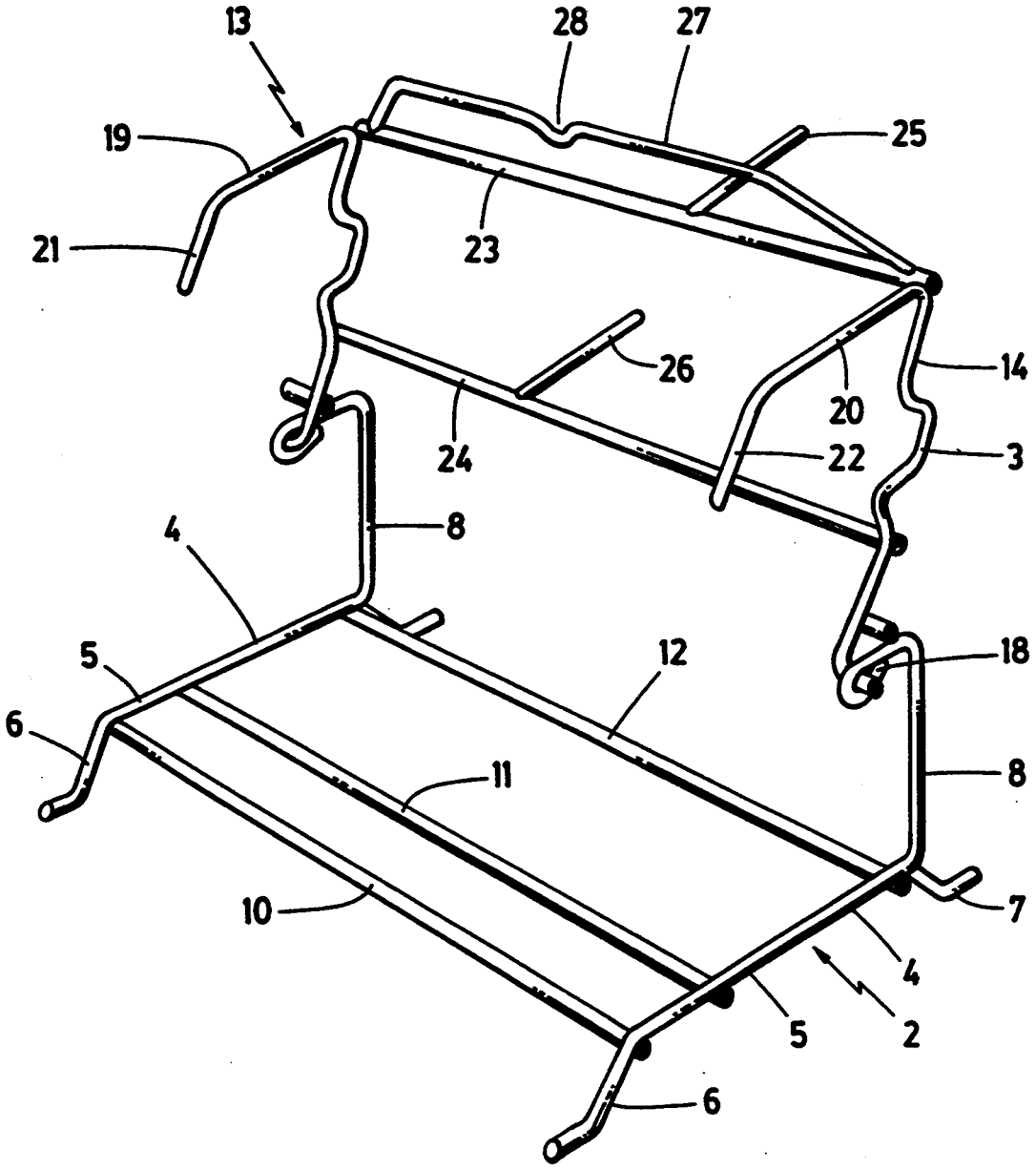
FIG. 2 is a perspective view of the rack of the present invention in the open position.

The base 2 consists of left and right side members 4. Each side member 4 has a horizontal rail 5, front and rear legs 6 and 7 respectively, generally vertical upright 8 and pivot means 9. In the preferred embodiment the front leg 6, horizontal rail 5, vertical upright 8 and pivot means 9 are formed from one piece of low-carbon steel wire rod bent as illustrated in FIG. 1. The rear leg 7 can be welded to the rear end of the horizontal rail. The pivot means 9 in the preferred embodiment is formed by bending a loop 18 in the upper end of the vertical upright. The front and rear legs are sized to permit sufficient air flow under the base of the rack. The side members 4 are connected by horizontal bars 10, 11 and 12. Bars 10 and 11 are positioned at the front of the side members so that they can support the paper wrapped fire-log(s). Bar 12 connects the rear corner of each of the side members 4. Additional support bars may be added as desired to provide support for additional fire-logs or conventional firewood.

The base 2 is sized to fit conventional residential fireplaces. In the preferred embodiment the base is 18 inches wide, 11 inches deep and 5.5 inches high.

The upper frame 3 consists of left and right laterally disposed side sections 13 and 14 respectively. The rear end 15 and 16 of each of the left and right side sections is adapted for pivotal connection to the base 2 at pivot means 9. In the preferred embodiment the rear end of the side sections is bent outwardly at a right angle to form pins 17 adapted to fit in loops 18.

The front portion of each side member is adapted so that the upper frame is supported when in the closed position. In the preferred embodiment the front portion of each side member is bent rearwardly at about a 45° angle to form support bars 19 and 20. The lower end of support bars 19 and 20 is bent rearwardly again to form horizontal sections 21 and 22 that, when the rack is closed, rest on fire-log positioning bar 11.

The left and right side sections are connected by front and rear fibre log support bars 23 and 24 respectively. Located along the length of the front and rear fibre log support bars 23 and 24 is means for retaining the fibre logs in position. In the preferred embodiment, the fibre log retaining means comprises upwardly projecting front and rear fibre log support pins 25 and 26. These pins are preferably about 5 inches long and are welded to the front and rear fibre log support bars tilted forwards at an angle of about 30° from the vertical.

In the preferred embodiment shown in the drawings a protector bar 27 is attached across the front and along the length of the front fibre support bar 23. The protector bar 27 is formed to extended outwardly and downwardly from the front fibre support bar 23. A centrally disposed non-slip V-notch 28 is formed into the protector bar 27. This permits the upper frame of the rack to be opened by placing a poker in the notch and lifting without damaging the fibre logs. Alternative configurations for permitting the rack to be opened without damaging the fibre log are possible and the present invention is intended to include such other variations.

A stopper means can be attached to the rack to limit movement of the upper frame to permit the paper wrapped logs to be placed on the rack without having to hold the upper frame open and yet permit the upper frame to be easily closed. In the preferred embodiment the stopper means consists of stopper bars 29 welded at right angles on the top surface of side sections 13 and 14. The stopper bars are located at the rear of the side sections adjacent the pivotal connection to the base, so that when the upper frame is lifted the stopper means will rest on the top of the uprights 8 and prevent further movement of the upper frame.

As shown in FIG. 3, vacuum formed ceramic fibre logs are placed on the upper frame and secured in place by pins 25 and 26. In addition side sections 13 and 14 are bent to provide additional support for the fibre logs. In the preferred embodiment, one fibre log 31 is located across the front of the rack, a second fibre log 32 is located across the rear of the upper frame and a third fibre log 33 is located across the top of the first and second logs. When a paper wrapped log 34 is placed on the rack, the flames burn up through the fibre logs. The fibre logs are disposed on the rack to block sight of the paper wrapped fire log and most of the upper frame thereby giving the appearance and ambience of a real pile of logs burning.

The rack of the present invention can be used in woodburning masonry and steel fireplaces and/or acorn type portable patio/deck or RV fireplace units.

It will be appreciated that the above description related to the preferred embodiment by way of example only. Many variations on the invention will be obvious to those knowledgeable in the field, and such obvious variations are within the scope of the invention as described and claimed, whether or not expressly described. For example the base can be designed as a regular fireplace grate to accommodate paper wrapped fire-logs and firewood. The rack could be expanded to centre-open for see-through or 2-sided fireplaces. The base could even be provided with means for raising the fire-logs as they burned and lost weight to keep the flames as high as possible.

The claims of the invention are:

1. A fireplace rack comprising a base having a front and rear end for supporting one or more paper wrapped compressed fire logs, and an upper frame having a front and rear end, said base consisting of a pair of laterally disposed side members connected by one or more horizontal bars wherein said side members each consist of a horizontal rail having a front and rear end, front and rear legs and a generally vertical upright connected to the rear end of said rail and said upright having pivot means at its distal end wherein said the front leg, horizontal rail, vertical upright and pivot means of each side member are formed from one piece of wire rod, and said upper frame consists of a pair of laterally disposed side sections connected by front and rear support bars, each of said side sections at the rear end of said upper frame is adapted for pivotal connection to the pivot means on said vertical upright of said side members so that the rack may be opened at the front end to permit a paper wrapped compressed fire log to be placed on the base, and wherein said upper frame is adapted to support a display of artificial logs so that when lit, the paper wrapped compressed fire logs burn up through the artificial logs to give the ambience and appearance of a real pile of logs burning.

2. The fireplace rack of claim 1 in combination with a display of artificial logs.

3. The combination of claim 2 wherein the artificial logs are ceramic fibre artificial logs.

4. The combination of claim 3 wherein the artificial logs are vacuum formed.

5. The combination of claim 3 wherein the display of artificial logs includes front and rear logs attached to the upper frame of the rack and one or more artificial logs placed across the top of said front and rear logs.

6. The fireplace rack of claim 1 wherein said front and rear legs are sized to permit sufficient air flow under the base.

7. The fireplace rack of claim 1 wherein said side members are connected by at least two horizontal bars at the front of said side members and said horizontal bars are adapted to support a paper wrapped compressed fire log.

8. The fireplace rack of claim 1 wherein a protector bar is provided across the front of said upper frame.

* * * * *